US005885137A

United States Patent [19]

Ploessl

[11] Patent Number: 5,885,137

[45] Date of Patent: Mar. 23, 1999

[54] CHEMICAL MECHANICAL POLISHING PAD CONDITIONER

[75] Inventor: Robert Ploessl, Fishkill, N.Y.

[73] Assignee: Siemens Aktiengesellschaft, Munich, Germany

[21] Appl. No.: 884,118

[22] Filed: Jun. 27, 1997

[51] Int. Cl.[6] ..... B24B 53/00

[52] U.S. Cl. ..... 451/56; 451/443

[58] Field of Search ..... 451/56, 41, 72, 451/443, 444, 456, 288, 287, 505, 495

[56] References Cited

U.S. PATENT DOCUMENTS

| | | | |
|---|---|---|---|
| 1,212,628 | 1/1917 | Gowlland | 451/505 |
| 5,230,184 | 7/1993 | Bukhman | 451/505 |
| 5,683,289 | 11/1997 | Hempel, Jr. | 451/56 |

FOREIGN PATENT DOCUMENTS

| | | | |
|---|---|---|---|
| 9134650 | 8/1984 | Japan | 451/65 |
| 2065967 | 3/1990 | Japan | 451/288 |

*Primary Examiner*—Robert A. Rose
*Attorney, Agent, or Firm*—Stanton C. Braden

[57] ABSTRACT

A polishing pad conditioner and a method for conditioning a polishing pad of a chemical/mechanical polishing system. The polishing pad conditioner includes a body defining an upper surface and a lower surface; at least one conditioning element mounted at the lower surface of the body, the conditioning element including a conditioning surface and an opening adjacent the conditioning surface; and a vacuum source operatively connected to the opening in the conditioning element. The method for conditioning a polishing pad includes the steps of holding a polishing pad conditioner including a conditioning element, a conditioning surface thereon and an opening in the conditioning element adjacent the conditioning surface in contact with a surface of the polishing pad; applying a vacuum source to the pad, the vacuum source being operatively connected to the conditioning element; and conditioning the surface of the polishing pad while simultaneously vacuuming particles therefrom.

9 Claims, 3 Drawing Sheets

CHEMICAL MECHANICAL POLISHING PAD CONDITIONER

BACKGROUND OF THE INVENTION

1. Technical Field

The present disclosure relates to semiconductor device fabrication and, more particularly, to an improved chemical mechanical polishing ("CMP") of a semiconductor wafer which results in a more efficient yield of in the manufacturing of semiconductor devices.

2. Description of the Related Art

Advances in electronic devices generally include reducing the size of the components that form integrated circuits. ICs, such as memory chips, logic devices, and the like. With smaller circuit components, the value of each unit area of a semiconductor wafer becomes higher. This is because the ability to use all of the wafer area for IC components improves. To properly form an IC that employs a much higher percentage of usable wafer area, it is critical that contaminant particle counts on the semiconductor wafer surface be reduced below levels which were previously acceptable. For example, minute particles of oxides and metals of less than 0.2 microns are unacceptable for many of the popular advanced circuit designs, because they can short out two or more conducting lines. In order to clean a semiconductor wafer and remove unwanted particles, a process known as chemical mechanical polishing ("CMP") has achieved widespread success.

Generally, CMP systems place a semiconductor wafer in contact with a polishing pad that moves relative to the semiconductor wafer. The semiconductor wafer may be stationary or it may also rotate on a carrier that holds the wafer. Between the semiconductor wafer and the polishing pad, CMP systems often use a slurry. The slurry is a liquid having the ability to lubricate the moving interface between the semiconductor wafer and the polishing pad while mildly abrading and polishing the semiconductor wafer surface with a polishing agent, such as silica or alumina.

During the CMP process, since the polishing pad contacts the semiconductor wafer, it is common for the polishing pad to eventually erode or wear unevenly across its surface. Therefore, the polishing pad must be conditioned periodically by a conditioning assembly. The conditioning assembly typically includes a plurality of diamonds on its conditioning surface and moves laterally across the polishing pad to uniformly condition the surface of the pad.

One of the fundamental problems associated with conventional CMP systems is the accumulation of particles and debris on the surface of the polishing pad which typically stem from the polishing process and the conditioning process. The particles and debris adversely affect the polishing process since they tend to scratch the surface of the semiconductor wafer and, like containments, can detrimentally affect operation of the resulting integrated circuit.

Another problem associated with conventional CMP systems is that the surface of the polishing pad may wear unevenly, since wafers are typically aligned in one position on the surface of the polishing pad, thereby detrimentally affecting the polishing uniformity. In an attempt to correct this problem, conventional pad conditioners incorporate the ability to move laterally across the surface of the pad. However, they do not have a means for adjusting the relative position of the conditioning elements with respect to the pad, to optimize the conditioning intensity.

Therefore, a need exists for an improved method and apparatus for conditioning a polishing pad of a CMP system which removes particles and debris from the surface of the pad and enables the optimization of the conditioning intensity.

SUMMARY OF THE INVENTION

The present apparatus and method includes a polishing pad conditioner which overcomes the problems associated with conventional CMP systems. The polishing pad conditioner comprises a body defining an upper surface and a lower surface; a conditioning element mounted at the lower surface of the body, the conditioning element including a conditioning surface and an opening adjacent the conditioning surface; and a vacuum source operatively connected to the opening in the conditioning element. The polishing pad conditioner may further comprise an arm attached to the upper surface of the body wherein the vacuum source is operatively connected to the opening in the conditioning element through a passage in the arm.

In another embodiment, a polishing pad conditioner is provided which comprises a body defining a cavity; a flexible membrane positioned to enclose the cavity; at least one conditioning element mounted on the flexible membrane; and means for adjusting the pressure within the cavity. The means for adjusting the pressure within the cavity may comprise a fluid source, such that a profile of the flexible membrane may be varied in response to a reduced or increased pressure within the cavity to optimize the conditioning process. In yet another embodiment, a method for conditioning a polishing pad is provided which comprises the steps of holding a polishing pad conditioner including a conditioning element, a conditioning surface thereon and an opening in the conditioning element adjacent the conditioning surface in juxtaposition relative to a surface of the polishing pad; applying a vacuum source to the pad, the vacuum source being operatively connected to the opening in the conditioning element; and conditioning the surface of the polishing pad while simultaneously vacuuming particles therefrom.

In still another embodiment, a hybrid polishing pad conditioner is provided which incorporates all features of the present disclosure in one apparatus.

These and other objects, features and advantages will become apparent from the following detailed description of illustrative embodiments, which is to be read in connection with the accompanying drawings.

BRIEF DESCRIPTION OF THE DRAWINGS

For a better understanding of the present CMP pad conditioner, reference is made to the following description of exemplary embodiments thereof, and to the accompanying drawings wherein.

DETAILED DESCRIPTION OF THE INVENTION

Generally, the present invention relates to a polishing pad conditioner and a method for conditioning a polishing pad of a chemical/mechanical polishing system. In one embodiment, the polishing pad conditioner comprises a body portion, at least one conditioning element including a conditioning surface, and a vacuum source operatively connected to an opening in the conditioning element. In another embodiment, the polishing pad conditioner comprises a body portion which defines a cavity, a flexible membrane positioned to enclose the cavity, at least one conditioning element mounted thereon, and means for adjusting a pressure within the cavity to vary a profile of the flexible membrane. Advantages derivable from the present polishing pad conditioner generally include the ability to provide a more efficient yield of semiconductor wafers. More specifically, the polishing pad conditioner provides means for removing debris and particles from the surface of a polishing pad, and means for optimizing the conditioning process.

Figure 1:
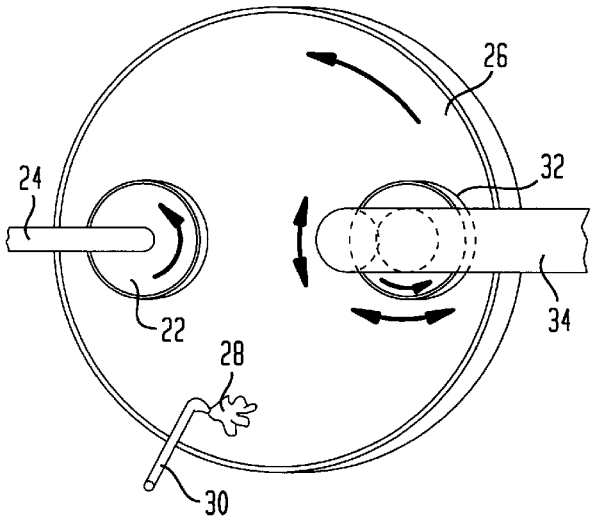
FIG. 1 is a top view of an apparatus for chemical/mechanical polishing a surface of a semiconductor wafer.

Referring now to the drawings in detail, FIG. 1 illustrates one stage in the typical semiconductor wafer CMP process that incorporates an embodiment of invention. To initiate the process, wafer carrier 22, which is attached to robotic arm 24, retrieves a semiconductor wafer (not shown) from a load cassette which may contain numerous semiconductor wafers. The semiconductor wafer comprises a plurality of ICs, such as logic devices or random access memories (RAMs) including dynamic RAMs (DRAMs), static RAMs (SRAMs),and synchronous DRAMs (SDRAMs). The ICs on the wafer may be at varying stages of processing. The semiconductor wafer is typically held on the bottom surface of wafer carrier 22 by a vacuum force. Wafer carrier 22 is then transferred to the location shown in FIG. 1 where it holds a surface of the semiconductor wafer in juxtaposition relative to a polishing pad 26 with an applied pressure between wafer carrier 22 and polishing pad 26.

Polishing pad 26 may be mounted on a platen which causes pad 26 to rotate, in this example, counter clockwise. During polishing, wafer carrier 22 may also rotate so that the surface of the semiconductor wafer contacts polishing pad 26 while each are moving. Although wafer carrier 22 is shown rotating in the same direction as polishing pad 26 (i.e., counterclockwise), it may also rotate in a direction opposite that of polishing pad 26. The rotary force, together with the polishing surface of pad 26 and the lubricating and abrasive properties of slurry 28, polishes the semiconductor wafer. Slurry dispensing mechanism 30 dispenses a required quantity of slurry 28 to coat pad 26. Although the process has been described wherein polishing pad 26 rotates, it is contemplated that polishing pad 26 can move in a lateral direction or a combination of lateral and rotational directions.

Since polishing pad 26 will eventually erode or wear across its surface, polishing pad conditioner 32 is provided to condition the surface of polishing pad 26 to maintain a constant polishing rate and a uniform polishing process. Polishing pad conditioner 32 may rotate, either in a direction the same as or opposite to that in which polishing pad 26 rotates. Also, polishing pad conditioner 32 may be moved laterally, diametrically or radically over pad 26 under the control of robotic arm 34 in order to create a polishing pad profile which is larger than the diameter of polishing pad conditioner 32.

After polishing of the semiconductor wafer surface is complete, robotic arm 24 transfers wafer carrier 22 and the semiconductor wafer to a cleansing station (not shown) wherein residual slurry is removed from the semiconductor wafer by an aqueous solution spray. The aqueous solution, for example, includes a pH controlling compound for controlling the predetermined pH of the slurry and removing the slurry from the semiconductor wafer. The solution may include a concentrated $NH_4OH$ mixture as disclosed in U.S. Pat. No. 5,597,443 to Hempel, which is herein incorporated by reference for all purposes. Thereafter, the semiconductor wafer is transferred to an unload cassette where it may be subjected to further processing.

As previously discussed, a problem associated with conventional CMP systems is the accumulation of debris and particles, that stem both from the polishing process and the conditioning process, on the surface of polishing pad 26 which causes defects on the surface of the semiconductor wafer being polished.

Figure 2:
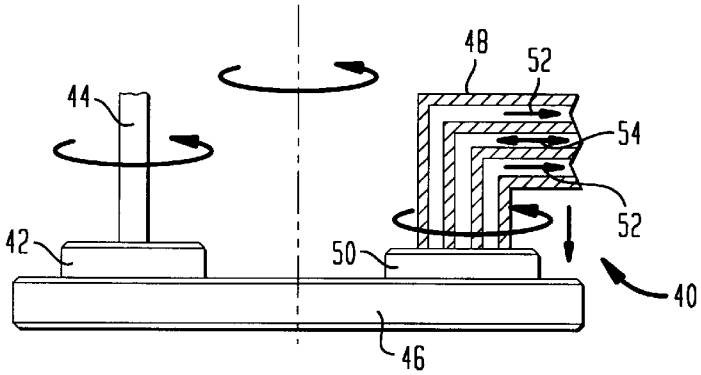
FIG. 2 is a side view of an apparatus similar to that shown in FIG. 1 illustrating a partial cross-section of the present CMP conditioner.

Referring to FIG. 2, a polishing pad conditioner in accordance with one embodiment of the invention is shown. As shown, the polishing pad conditioner 40 a wafer carrier 42 attached to a robotic are 44 and polishing pad 46. Additionally, the polishing pad conditioner comprises 40 includes a plurality of passages in robotic arm 48 which communicate at a proximal end with body portion 50 of polishing pad conditioner 40. Illustratively, a distal end of each of the two outer passages 52 is operatively connected to a vacuum source which applies a vacuum to the surface of polishing pad 46, as will be discussed in greater detail below. A distal end of the center passage 54 is operatively connected to a fluid source for varying the position of a flexible membrane located within the polishing pad conditioner body portion 50, as will be discussed in greater detail below. Thus, it is contemplated that the embodiment of polishing pad conditioner 40 shown in FIG. 2 is a hybrid which may incorporate at least one of the features of the embodiments that will be discussed with reference to FIGS. 3–7.

Figure 3:
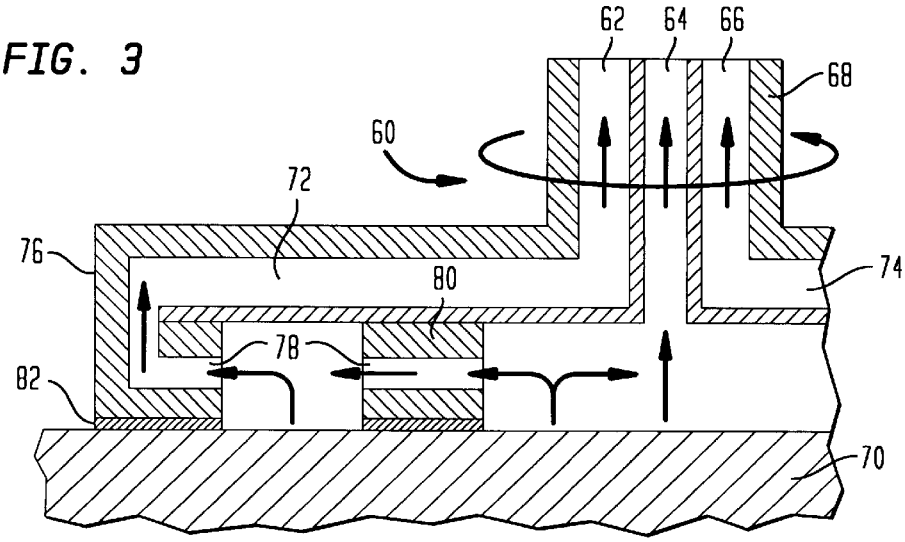
FIG. 3 is a partial cross-sectional side view of a polishing pad conditioner in accordance with a first embodiment.

Referring now to FIG. 3, polishing pad conditioner 60 illustrates an embodiment which comprises a vacuum source (not shown) operatively connected at a distal end of at least one of the passages 62, 64 and 66 formed in robotic arm 68. The center passage 64 extends through arm 68 and opens to a void formed by a lower surface of body portion 76, conditioning elements 80 and the surface of polishing pad 70. The two outer passages 62 and 66 communicate with passages 72 and 74 in body portion 76, and openings 78 in conditioning elements 80. Thus, the vacuum source is operatively connected to the surface of polishing pad 70 to remove debris and particles therefrom in the direction of the arrows. It is also contemplated that a single passage may connect a vacuum source with a surface of polishing pad 70 rather than the plurality of passages described above. Advantageously, the vacuum force may be adjusted to effectively remove the particles while leaving a substantial amount of the slurry on polishing pad 70. Also, as the conditioning surface 82 of conditioning elements 80 conditions the surface of polishing pad 70, surface 82 will form a seal at the surface of pad 70 such that the vacuum force is maintained and the debris and particles resulting from the conditioning process will be effectively removed.

Figure 6:
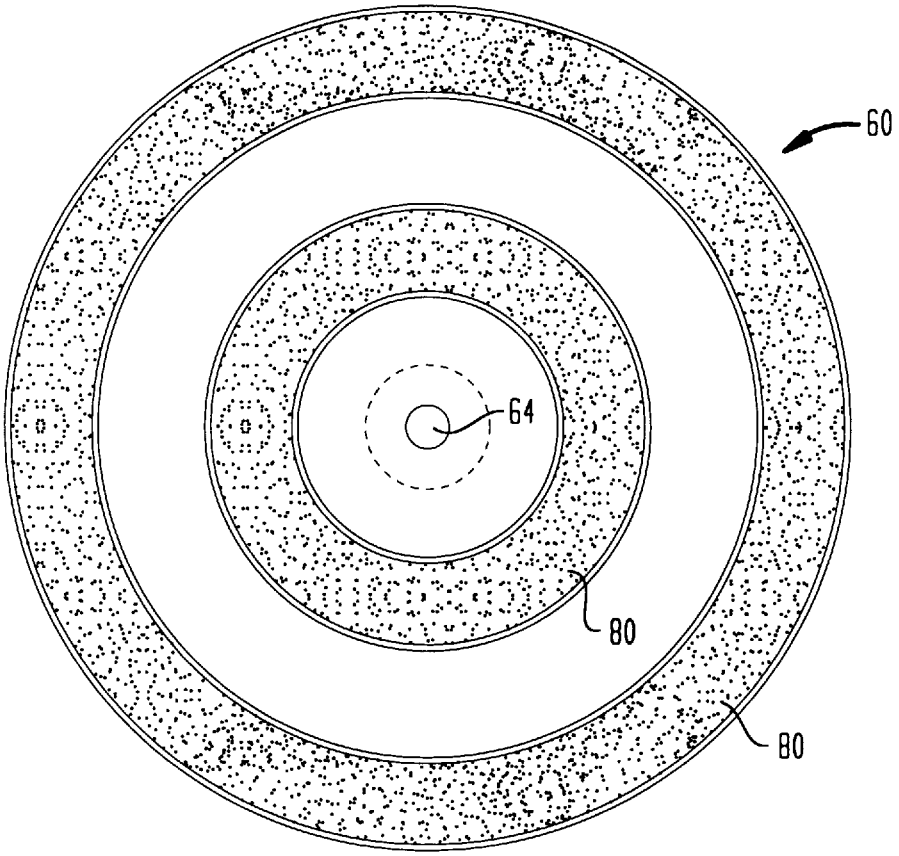
FIG. 6 is a bottom view illustrating a geometrical configuration of a plurality of conditioning elements.

Although other configurations may be contemplated, the preferred geometric configuration of conditioning elements 80 of FIG. 3 is illustrated in FIG. 6. Thus, the polishing pad conditioner illustrated in FIG. 3 allows the conditioning process and the removal of debris and particles to occur simultaneously and adjacent each other to eliminate or minimize the amount of debris and particles which may adversely affect the surface of a semiconductor wafer subjected to chemical/mechanical polishing.

Figure 4:
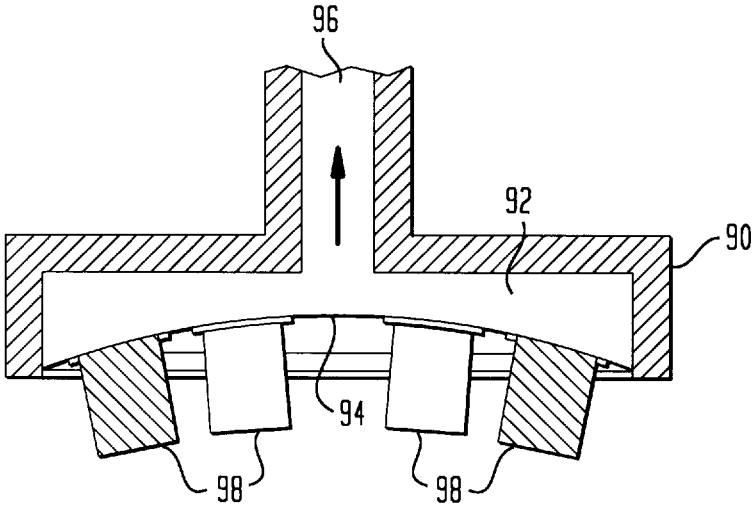
FIG. 4 is a cross-sectional side view of a polishing pad conditioner having a concave flexible membrane in accordance with another embodiment.
Figure 5:
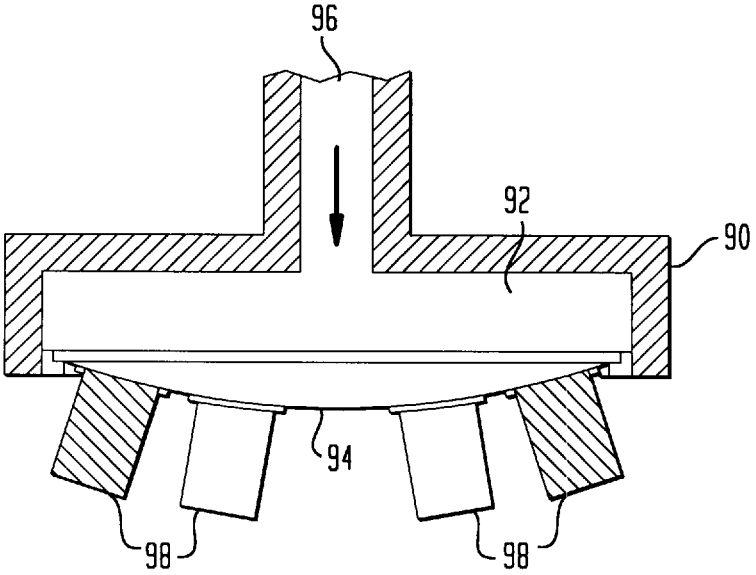
FIG. 5 is a cross-sectional side view of the polishing pad conditioner of FIG. 4 having a convex flexible membrane.

As illustrated in FIGS. 4 and 5, another embodiment of the present polishing pad conditioner includes a body portion 90 which defines a cavity 92. A flexible membrane 94 is positioned to enclose cavity 92, and is fixed on its periphery. A passage 96 having a proximal end which opens to cavity 92 on the upper surface of flexible membrane 94 is operatively connected at a distal end with a fluid source for generating an increased or reduced pressure within passage 96 and cavity 92.

As illustrated in FIG. 4, the center of flexible membrane 94 will flex upward in the direction of the arrow in response to a reduced pressure within cavity 92 and passage 96. Thus the profile of flexible membrane 94 will be concave with respect to a polishing pad. As shown, conditioning elements 98, mounted on the bottom surface of membrane 94, will be drawn away from the surface of a polishing pad, thereby changing the conditioning intensity and providing the ability for controlling the pad profile. In one embodiment, the pad profile is adjusted to result in an optimum polish uniformity. The reduced pressure within cavity 92 and passage 96 is, for example, preferably in the range of about 0 psig to 5 psig. Other pressures that result in the desired pad profile are also useful.

As illustrated in FIG. 5, the center of flexible membrane 94 will flex downward in the direction of the arrow, in response to an increased pressure within cavity 92 and passage 96. Thus the profile of flexible membrane 94 will be convex with respect to a polishing pad. As shown, conditioning elements 98, mounted on the bottom surface of flexible membrane 94, will be extended out toward a surface of a polishing pad, thereby changing the conditioning intensity by controlling the pad profile that will result in an optimum polish uniformity. The increased pressure within cavity 92 and passage 96 is, for example, in the range of about 0 psig to 5 psig. Additionally, other pressures that produce the desired pad profile are also useful.

The purpose of providing a flexible membrane is to control the pad profile, thereby allowing an operator to optimize the conditioning process. Although varying the profile of flexible membrane 94 has been described with reference to a passage which typically communicates a pneumatic, hydraulic or vacuum pressure other techniques such as, for example, employing piezo electric are also useful. The applied pressure between conditioning elements 98 and a polishing pad may also be controlled by the robotic arm by varying the distance body portion 90 is located from the polishing pad, to further optimize polishing uniformity. Notwithstanding an increased or decreased in pressure imposed by the fluid source or other means, the flexible membrane will also flex mechanically by varying the force on the body portion 90 via the robotic arm. It is contemplated that the polishing pad conditioner may be adjusted to maintain contact with a surface of a pad while compensating for a loss in pad thickness due to its erosion.

Figure 7:
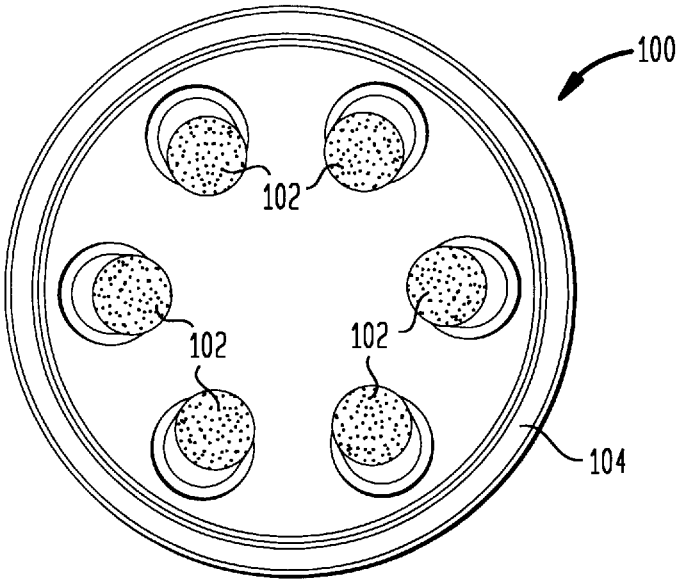
FIG. 7 is a bottom view illustrating another geometrical configuration of a plurality of conditioning elements.

It is contemplated that a plurality of conditioning elements having different geometrical configurations may be utilized by the present polishing pad conditioner. Two embodiments thereof are illustrated in FIGS. 6 and 7. As discussed above, conditioning elements 80 illustrated in FIG. 6, which form a plurality of concentric circular rings, may be advantageously utilized in the polishing pad conditioner illustrated in FIG. 3. FIG. 7 illustrates a polishing pad conditioner 100 having a plurality of substantially circular shaped conditioning elements 102. Where it is advantageous to utilize substantially circular shaped polishing elements 102, for example in the embodiment described with respect to FIG. 3, a seal 104 may be provided on the outer periphery of polishing pad conditioner 100 to maintain the vacuum force. In either geometrical configuration, a plurality of diamonds are preferably mounted on the surface of conditioning elements 80 and 102 to facilitate the conditioning process.

Although the illustrative embodiments have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A polishing pad conditioner for a chemical/mechanical polishing system for polishing a semiconductor wafer comprising:

a body defining a cavity;

a flexible membrane positioned to enclose the cavity;

at least one conditioning element mounted on the flexible membrane; and means for adjusting a pressure within the cavity to vary a position of the membrane with respect to a polishing pad.

2. A polishing pad conditioner for a chemical/mechanical polishing system as recited in claim 1, wherein the means for adjusting the pressure within the cavity comprises a fluid source.

3. A polishing pad conditioner for a chemical/mechanical polishing system as recited in claim 2, wherein the flexible membrane has a concave profile with respect to the polishing pad as a result of a reduced pressure within the cavity.

4. A polishing pad conditioner for a chemical/mechanical polishing system as recited in claim 2, wherein the flexible membrane has a convex profile with respect to the polishing pad as a result of an increased pressure within the cavity.

5. A polishing pad conditioner for a chemical/mechanical polishing system as recited in claim 1, wherein the conditioning element includes a conditioning surface carrying diamond particles thereon.

6. A polishing pad conditioner for a chemical/mechanical polishing system as recited in claim 1, wherein the at least one conditioning element mounted on the flexible membrane has a substantially circular shape.

7. A polishing pad conditioner for a chemical/mechanical polishing system as recited in claim 1, wherein a plurality of conditioning elements forming concentric rings are mounted on the flexible membrane.

8. A polishing pad conditioner for a chemical/mechanical polishing system as recited in claim 1, further comprising an arm attached to an upper surface of the body, said body being rotatable with respect to the arm.

9. A polishing pad conditioner for a chemical/mechanical polishing system comprising:

a body defining an upper surface and a lower surface;

at least one conditioning element mounted at the lower surface of the body, the conditioning element including a conditioning surface and an opening adjacent the conditioning surface; and a vacuum source operatively connected to the opening in the conditioning element, wherein at least a portion of the lower surface of the body comprises a flexible membrane and at least one conditioning element is mounted on said membrane.

* * * * *